US006995732B2

(12) United States Patent
Goebel et al.

(10) Patent No.: US 6,995,732 B2
(45) Date of Patent: Feb. 7, 2006

(54) BROADBAND ANTENNA HAVING A THREE-DIMENSIONAL CAST PART

(75) Inventors: Uhland Goebel, Wila (CH); Mischa Graeni, Fehraltorf (CH); Jan Hesselbarth, Sennhof (CH); Peter Nuechter, Hinwil (CH); Martin Wagner, Effretikon (CH)

(73) Assignee: Huber & Suhner AG, Herisau (CH)

( * ) Notice: Subject to any disclaimer, the term of this patent is extended or adjusted under 35 U.S.C. 154(b) by 11 days.

(21) Appl. No.: 10/744,233

(22) Filed: Dec. 22, 2003

(65) Prior Publication Data

US 2004/0155831 A1 Aug. 12, 2004

(30) Foreign Application Priority Data

Dec. 23, 2002 (CH) ..... 2210/02

(51) Int. Cl.
*H01Q 1/52* (2006.01)
*H01Q 7/04* (2006.01)
*H01Q 7/00* (2006.01)

(52) U.S. Cl. ..... 343/908; 343/700 MS; 343/841; 343/842; 343/866

(58) Field of Classification Search ..... 343/700 MS, 343/793, 797, 798, 866, 908, 909, 726, 727, 343/732, 794, 841, 842, 912
See application file for complete search history.

(56) References Cited

U.S. PATENT DOCUMENTS 2,086,976 A 7/1937 Brown
2,166,750 A 7/1939 Carter
4,510,501 A * 4/1985 Woodward et al. ..... 343/742
4,804,965 A * 2/1989 Roederer ..... 343/700 MS
5,285,210 A 2/1994 Sato et al.
5,563,616 A * 10/1996 Dempsey et al. ..... 343/753
6,034,645 A 3/2000 Legay et al.
6,057,802 A * 5/2000 Nealy et al. ..... 343/700 MS
6,195,063 B1 * 2/2001 Gabriel et al. ..... 343/797
6,313,809 B1 * 11/2001 Gabriel et al. ..... 343/797
6,333,720 B1 * 12/2001 Gottl et al. ..... 343/810

(Continued)

FOREIGN PATENT DOCUMENTS

AU 723262 9/1997

(Continued)

OTHER PUBLICATIONS

M. C. Bailey; Broadband Half-Wave Dipole; IEEE Transactions On Antennas And Propagation, Apr. 1984, pp. 410-412, vol. Ap-32, No. 4.*

(Continued)

*Primary Examiner*—Wilson Lee
*Assistant Examiner*—Leith A. Al-Nazer
(74) *Attorney, Agent, or Firm*—Moetteli & Assoc.; John Moetteli; Sherman D. Pernia

(57) ABSTRACT

An antenna (10) having an emitter element which is positioned in front of a conductive reflector (13) and has a three-dimensional cast part. The cast part is implemented as conductive and has a closed peripheral structure (11) having alternating constrictions and bulges. The peripheral structure (11) spans an imaginary surface (14) which is intersected by at least two planes of symmetry (15.1, 15.3) of the cast part. At least two fastening elements (12.1, 12.2) are provided, which extend essentially perpendicular to the imaginary surface (14) and support the peripheral structure (11) at two points which lie on one of the planes of symmetry (15.1; 15.3). At the lower ends (16), the fastening elements (12.1, 12.2) are connected to the reflector (13), the fastening elements (12.1, 12.2) also being used for electrical excitation of the emitter element.

19 Claims, 6 Drawing Sheets

U.S. PATENT DOCUMENTS

| | | | | |
|---|---|---|---|---|
| 6,400,331 | B2 * | 6/2002 | Kitayoshi | 343/793 |
| 6,583,766 | B1 * | 6/2003 | Rawnick et al. | 343/841 |
| 6,697,019 | B1 * | 2/2004 | Hyuk-Joon et al. | 343/700 MS |
| 6,734,829 | B1 * | 5/2004 | Gottl | 343/815 |
| 6,762,729 | B2 * | 7/2004 | Egashira | 343/767 |
| 2004/0145526 | A1 * | 7/2004 | Puente Baliarda et al. | 343/700 MS |
| 2004/0201537 | A1 * | 10/2004 | Stolle et al. | 343/797 |

FOREIGN PATENT DOCUMENTS

| | | | |
|---|---|---|---|
| DE | 198 60 121 | A1 | 7/2000 |

OTHER PUBLICATIONS

M.C. Bailey; Broadband Half-Wave Dipole; IEEE Transactions On Antennas And Propagation, Apr. 1984, pp. 410-412, vol. Ap-32, No. 4.*

G. J. Phillips, A wide-band aerial system for circularly polarized waves, suitable for ionospheric research, Paper No. 1121, Radio Section, Pp. 237-239.

M. C. Bailey, Broad-band Half-Wave Dipole, IEEE transactions on antennas and propagation, Apr. 1984, Pp. 410-412, vol. Ap-32, No. 4.

* cited by examiner

BROADBAND ANTENNA HAVING A THREE-DIMENSIONAL CAST PART

BACKGROUND OF THE INVENTION

The present invention relates to communication antennas, and in particular, antennas which have an emitter element positioned in front of a reflector surface.

Crossed dipole antennas for generating linear or circular polarizations are known. A crossed dipole antenna is known from the article "A wide-band aerial system for circularly polarized waves, suitable for ionospheric research", G. J. Phillips, IEE Proc., Vol. 98 III, 1951, p. 237—239. Turnstile antennas are described in various U.S. patents. An example is shown in U.S. Pat. No. 2,086,976 from 1935. The antenna shown includes a mast on which multiple crossed antennas are positioned. There are also numerous textbooks which are concerned with turnstile antennas.

In order to improve the directional efficiency, the antenna elements are frequently positioned in front of a metallic reflector surface. This approach is known and is applied in the following two antennas. A dual polarized dipole antenna may be inferred from U.S. Pat. No. 6,313,809 (which essentially corresponds to German Published Application 198 60 121 A1) of the firm Kathrein. These dipole antennas are distinguished in that they include a number of individual dipole elements which are positioned in front of a reflector. The dipole elements are positioned as a dipole square in a top view and each dipole element is fed individually via a symmetrical line.

A double-polarized multirange dipole antenna may be inferred from U.S. Pat. No. 6,333,720 of the firm Kathrein.

The bandwidth of a dipole antenna may be improved by using thick dipoles or bowtie dipole structures. Such a broadband dipole antenna is described in the article entitled "Broad-band half-wave dipole", M. C. Bailey, IEEE Trans. Antennas Prop., Vol. 32, 1984, p. 410–412. In addition, a broadband antenna having a thick dipole structure is cited in the Antenna Engineering Handbook, R. C. Johnson and H. Jasik, editors, 2$^{nd}$ Edition, McGraw Hill, 1984, on p. 28–11.

It is a problem of the antenna arrangements of the prior art, which are used in the field of communication and particularly mobile wireless communication, that the antennas are costly and heavy. This leads to expensive and complicated group antennas.

What is needed therefore, is a broadband dipole antenna which is simple and cost-effective. Further, what is needed is a dipole antenna which is suitable for installation in a group antenna.

SUMMARY OF THE INVENTION

An antenna meeting the needs identified above has an emitter element which is positioned in front of a conductive reflector and includes a three-dimensional cast part. The cast part has at least two planes of symmetry, is implemented as conductive, and has a closed peripheral structure having alternating constrictions and bulges. The peripheral structure preferably spans an imaginary surface which is intersected by the planes of symmetry of the cast part. At least two fastening elements are provided which extend essentially perpendicularly to the surface of the conductive reflector and support the peripheral structure at two support points—which preferably, but not necessarily, lie on intersection lines of the planes of symmetry with the imaginary surface. The at least two fastening elements run essentially parallel to one another and lie in the cylinder surface of an imaginary cylinder, whose longitudinal axis stands vertically on the surface of the conductive reflector. The planes of symmetry cited intersect one another in a joint intersection line which is coincident with the longitudinal axis.

The fastening elements preferably lie symmetrically in relation to the planes of symmetry, or in the limiting case, in the planes of symmetry. At their (lower) ends, the fastening elements are connected to the conductive reflector, at least one of the fastening elements being used for electrical excitation of the emitter element.

Further embodiments according to the present invention may be inferred from dependent claims 2 through 15.

According to the present invention, a group antenna having multiple emitter elements is provided, as claimed in claim 16. Further embodiments according to the present invention may be inferred from dependent claims 17 and 18.

BRIEF DESCRIPTION OF THE DRAWINGS

The present invention is described in detail on the basis of the exemplary embodiments illustrated in the drawings. Planes of symmetry are indicated in the drawings by dashed lines and imaginary surfaces are indicated by dotted lines where it is necessary for clearer illustration of the present invention.

DETAILED DESCRIPTION OF THE PREFERRED EMBODIMENT(S)

Figure 1A:
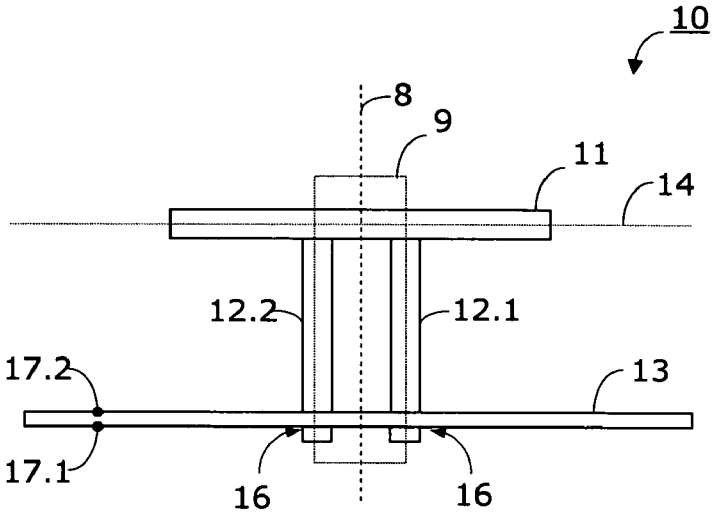
FIG. 1A shows an antenna according to the present invention in a schematic side view.

In this detailed description, terms which are frequently referred to are explained and defined.

In the following text, cast parts are discussed. According to the present invention, the term cast part is to be understood as molded parts which were produced in the (automatic) injection molding method. In this case, thermoplastics are processed using an injection molding method.

According to the present invention, various plastic injection molding compounds may be used in order to produce the molded parts. Some examples of plastics are listed in the following: PA (polyamide); POM (polyoxymethylene); PET (polyethylene terephthalate); PS (polystyrene); TPE (thermoplastic polyester elastomer); LCP (liquid crystal polymer); PBT (polybutylene terephthalate); SB (styrene/butadiene); SAN (styrene acrylonitrile); ABS (acrylate-butadiene-styrene); PPE (modified polyether); PVC (polyvinyl chloride); CA (cellulose acetate); CAB (cellulose acetate butyrate); CP (cellulose propionate); PE (polyethylene); PP (polypropylene); PMMA (polymethylmethacrylate); PC (polycarbonate); PSO (polyaryl sulfone); PES (polyether sulfone); PEI (polyether imide); PAI (polyamide imide); PVDF (polyvinylidene fluoride).

Polymer blends may also be used. These are combinations of two or more miscible polymers. Blending is processing, mixing, or reacting two or more polymers to obtain improved product properties.

Modified plastics having filler particles may also be used, which makes the construction of solidly adhering non-electrode or galvanically deposited metal coatings easier. The filler particles may be made of electrically conductive metals (e.g., palladium) or of electrically non-conductive metal pigments, as are used in spray lacquers for electromagnetic shielding. These metal pigments are used as a catalyst for non-electrode deposition of a metallic primer coating, which may subsequently be galvanically reinforced. The spray lacquer achieves only a limited adhesive strength, which is strongly dependent on the plastic material. By embedding the particles in the plastic compound, a significant improvement of the adhesive strength is achieved in that the particles are exposed only on the surface through a short pickling process, but otherwise remain enclosed by the plastic compound.

Instead of plastic, metals may also be used for producing the cast parts. Aluminum is especially suitable, which may be processed in the aluminum injection molding method. Molded parts made of zinc, magnesium (producible using thixotropic injection molding, for example), or titanium aluminum are also suitable.

Plastic injection molded parts which contain one or more metals may also be used.

The molded parts are distinguished in that a minimum of post-processing outlay is necessary. In addition, the dimensions of the molded parts are very precise.

Reflectors which preferably have a conductive surface may be used. This conductive surface may be set to ground. The reflector surface may be implemented as flat or curved.

Figure 1B:
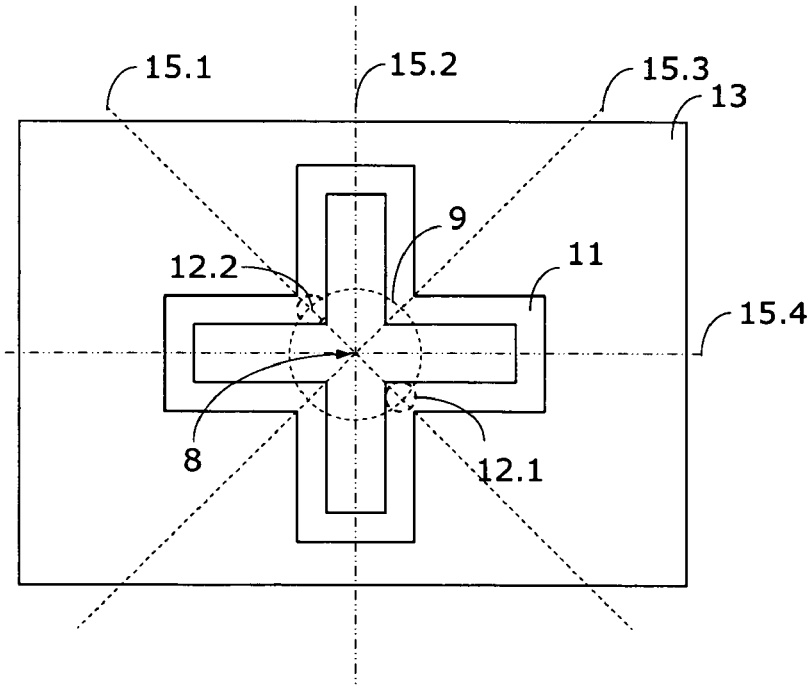
FIG. 1B shows the antenna shown in FIG. 1A in a schematic top view.

A first antenna 10 according to the present invention is shown in FIGS. 1A and 1B. An antenna 10 according to the present invention includes a three-dimensional emitter element which is positioned in front of a conductive reflector 13. The emitter element is a cast part. The cast part is implemented as conductive so that it is usable as an antenna. For this purpose, the cast part may be provided with a metal coating which partially or completely covers the cast part. Alternatively, the cast part may include electrically conductive particles which are embedded in a host material in such a way that the cast part is electrically conductive in at least the surface region. The cast part may, however, also be manufactured from material which is conductive per se. Metals or metal alloys are well suitable.

The cast part includes a closed peripheral structure 11 having alternating constrictions and bulges. In the example shown, the peripheral structure 11 has the shape of a cross spanning an imaginary surface 14 which is intersected by at least two planes of symmetry. The planes of symmetry intersect the imaginary surface 14 and thus form intersection lines 15.1 and 15.3, as shown in FIG. 1B on the basis of dashed lines. The actual peripheral structure 11 also has two axes of symmetry, which are indicated in FIG. 1B with 15.2 and 15.4, in addition to the two intersection lines 15.1 and 15.3.

At least two fastening elements 12.1, 12.2 are provided, which extend essentially perpendicularly to the surface of the conductive reflector 13. The fastening elements 12.1, 12.2 are connected to the peripheral structure 11 at two support points—which lie on the intersection lines in the embodiment shown. The at least two fastening elements 12.1, 12.2 run essentially parallel to one another and lie in the cylinder surface of an imaginary cylinder 9, whose longitudinal axis 8 stands vertically on the surface of the conductive reflector 13. The planes of symmetry 15.1 and 15.3 cited intersect one another in a joint intersection line which is coincident with the longitudinal axis 8.

As described, the fastening elements 12.1, 12.2 are connected to the peripheral structure 11 and support the peripheral structure 11 at two supporting points which lie on the intersection lines 15.1. At their other ends 16, the fastening elements 12.1, 12.2 are connected to the reflector 13. In addition to the support function, at least one of the fastening elements 12.1, 12.2 is used for electrical excitation of the emitter element.

Overall, the emitter element has a mushroom-like shape, in which the surface 14 spanned by the peripheral structure 11 forms the cap of the mushroom and the imaginary cylinder 9 forms the foot of the mushroom. The comparison of the emitter element to a mushroom-like shape is merely used to better illustrate the invention.

Fastening elements which have a column-like structure are especially suitable. The fastening elements are preferably an integral component of the peripheral structure 11. In this case, both the peripheral structure 11 and the fastening elements may be produced in one piece and therefore without additional assembly steps and assembly tolerances.

The fastening elements preferably have a cylindrical shape with a round cross-section, but may also have other cross-sectional shapes.

In a preferred embodiment, the fastening elements have fastening means at the lower end which allow the peripheral structure 11, including the fastening elements 12.1, 12.2, to be attached to the reflector 13. For this purpose, the fastening elements 12.1, 12.2 may be provided with a snap mechanism or a plug connector, for example, which allow the fastening elements 12.1, 12.2 to be placed in holes of the reflector 13 and catch therein. Screw, solder, or other connections may also be provided instead of a snap connector. Connectors which produce an electrically conductive connection in addition to a mechanical connection are ideal.

Figure 1C:
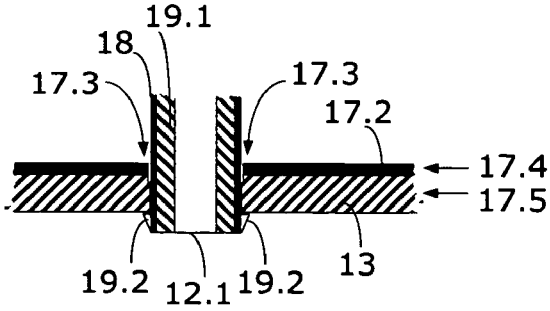
FIG. 1C shows a detail of the antenna shown in FIG. 1A in a schematic sectional view.

It must be ensured during the connection of the fastening elements 12.1, 12.2 to the reflector 13 that the reflector 13 is implemented as conductive with the front 17.2 (i.e., on the side of the reflector 13 which faces toward the peripheral structure 11), as indicated in FIG. 1C. At least one of the fastening elements 12.1 must therefore be attachable in the reflector 13 in such a way that it does not form a conductive connection to the conductive side 17.2 of the reflector 13. Otherwise, both fastening elements 12.1, 12.2 would be short-circuited via the conductive reflector 13, and the antenna could not be activated.

An example of the fastening and the electrical excitation of one of the fastening elements 12.1 is shown in FIG. 1C. The fastening elements 12.1 includes a cylinder whose wall 19.1 is provided with a conductive coating 18. The reflector 13 is formed by an electrically conductive coating 17.4 on the front 17.2 of a dielectric plate 17.5. The reflector 13 has a hole into which the lower end 16 of the fastening element 12.1 is guided. The fastening element 12.1 is prevented from falling out by lug-like projections 19.2, which allow the assembly process by snapping in. Spacing 17.3 between the conductive surface 17.4 and the fastening element 12.1 prevents a short-circuit of the feed signal. The feed signal is applied by a strip conductor on the rear of the reflector 13, for example, which has an electrically conductive connection to the conductive coating 18.

Figure 1D:
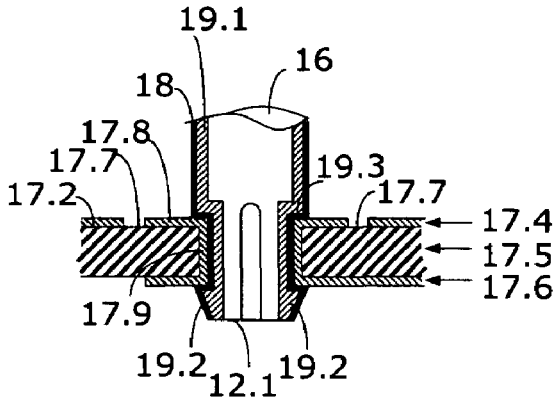
FIG. 1D shows a detail of a further fastening element according to the present invention in a schematic sectional view.

An especially advantageous example of the attachment and the electrical excitation of one of the fastening elements 12.1 is shown in FIG. 1D. The fastening element 12.1 includes a cylinder whose wall 19.1 is provided with a conductive coating 18. The reflector 13 is formed from an electrically conductive coating 17.4 on the front 17.2 of a dielectric plate 17.5. The reflector 13 has a hole into which the lower end 16 of the fastening element 12.1 is guided, a mechanical stop being formed by a graduation 19.3 of the cylinder diameter. The fastening element 12.1 is prevented from falling out by lug-like projections 19.2 which allow assembly through snapping in. An annular recess 17.7 of the electrically conductive coating 17.4 prevents a short-circuit of the feed signal. The feed signal is produced by a strip line 17.6 on the back of the reflector 13 which has an electrically conductive connection to the conductive coating 18. In a preferred embodiment shown in FIG. 1D, the strip line 17.6 and the region 17.8 separated from the electrically conductive coating 17.4 by the annular recess 17.7 are connected to one another by an electrically conductive coating 17.9, a via, which goes through the reflector 13.

Numerous other forms of attachment are conceivable (e.g., using an annular insulator insert or a clearance hole) in order to avoid contact between the fastening element and the conductive surface of the reflector.

In another embodiment, the side 17.2 of the reflector 13 facing toward the cast part is implemented as conductive. The rear side 17.1 may also be implemented as conductive. In addition, the conductive side of the reflector 13 may be partially or completely covered with a non-conductive coating in order to protect the reflector 13 from environmental influences. This non-conductive coating may be a plastic coating which is transparent to the electromagnetic fields.

Some of the antennas according to the present invention are distinguished in that they extend essentially parallel to the reflector 13 from the imaginary surface 14 spanned by the peripheral structure 11. The imaginary surface 14 may be flat or curved.

The reflector 13 may be slightly curved.

The advantages of the present invention are especially applicable if the reflector 13 has a supply circuit on the side 17.1 which faces away from the cast part. This supply circuit may be used for supplying the antenna. For this purpose, the supply circuit may include a network which connects a supply input to the two fastening elements 12.1, 12.2 in such a way that they may be activated in phase opposition.

Figure 2A:
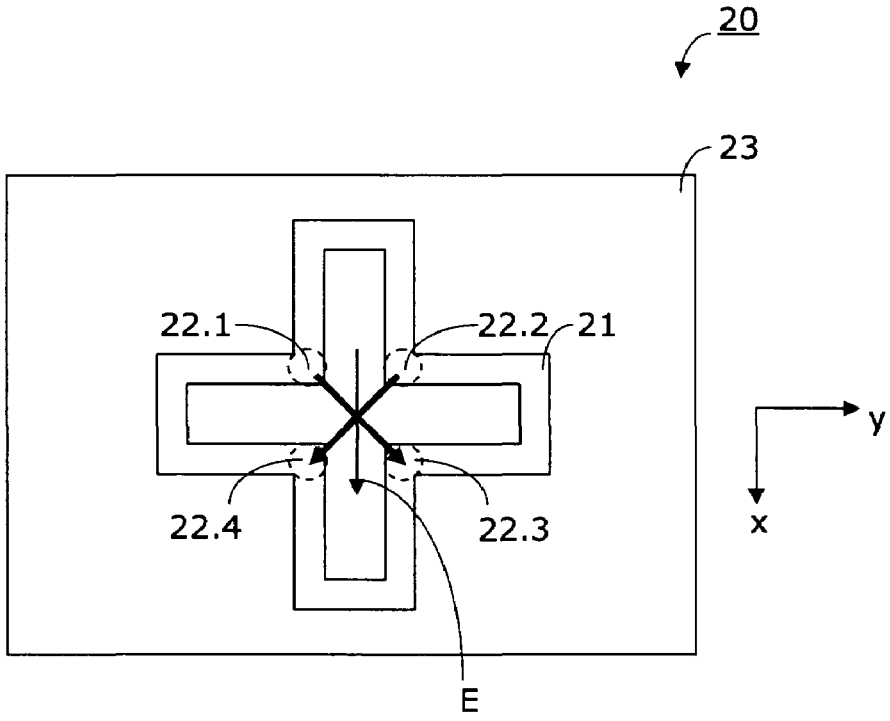
FIG. 2A shows a further antenna according to the present invention in a schematic top view, the emission being linearly polarized vertically.

Such activation with opposite phases is schematically shown in FIG. 2A. The antenna 20 includes a peripheral structure 21 similar to that in FIGS. 1A and 1B, but with four fastening elements 22.1 through 22.4 being provided. Both the two fastening elements 22.1 and 22.3 and the two fastening elements 22.2 and 22.4 are each activated with opposite phases. The two fastening elements 22.1 and 22.2 are excited in phase. As indicated by the three arrows in FIG. 2A, an electromagnetic field which is linearly polarized in the X direction (vertical polarization) arises due to the symmetrical implementation of the emitter element 21.

Figure 2B:
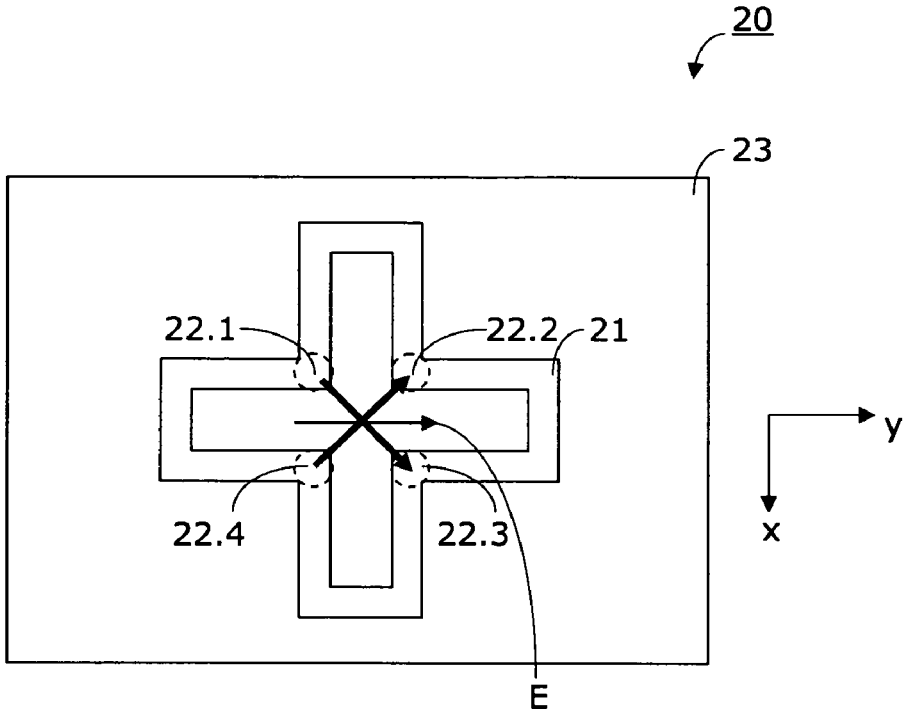
FIG. 2B shows a further antenna according to the present invention in a schematic top view, the emission being linearly polarized horizontally.

A different activation is schematically shown in FIG. 2B. Again, both the two fastening elements 22.1 and 22.3 and the two fastening elements 22.2 and 22.4 are each activated with opposite phases. However, now the two fastening elements 22.1 and 22.4 are excited in phase. As indicated by the three arrows in FIG. 2B, an electromagnetic field which is linearly polarized in the Y direction (horizontal polarization) arises due to the symmetrical implementation of the emitter element 21.

Figure 2C:
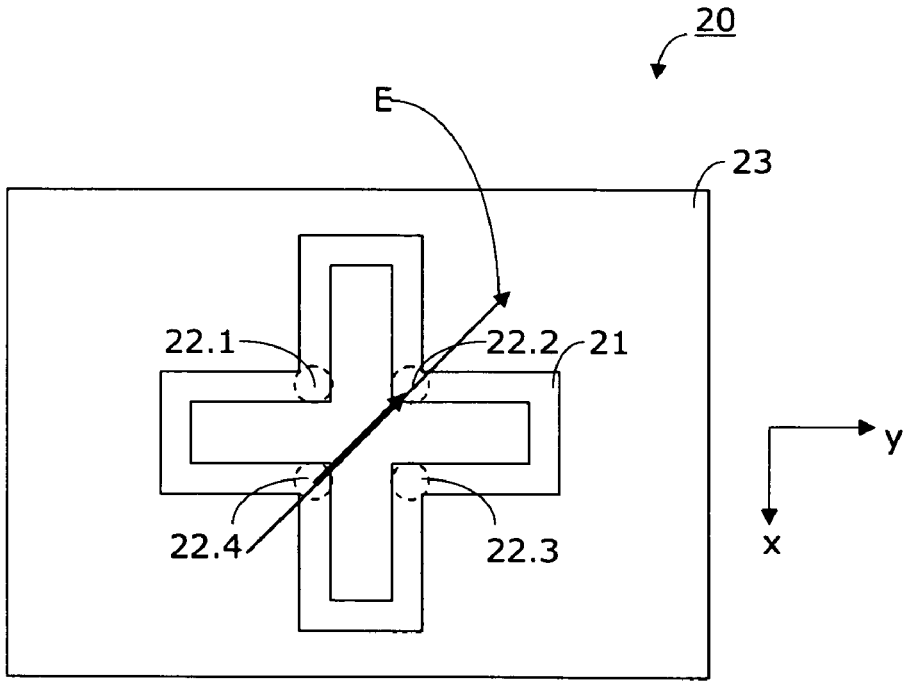
FIG. 2C shows a further antenna according to the present invention in a schematic top view, the emission being linearly polarized at 45°.

A simplified activation is schematically shown in FIG. 2C. The fastening element 22.4 is excited with a phase opposite to phase of the fastening element 22.2, as indicated by the arrow in FIG. 2C. An electromagnetic field which is linearly polarized −45° (−45° slant polarization) arises through the symmetric implementation of the emitter elements 21. In analogy to FIG. 1B, in this application the fastening elements 22.1 and 22.3 may be left out without significant effects on the antenna function, but the mechanical stability may possibly suffer. The fastening elements 22.1 and 22.3 may be electrically connected to the reflector 13 and/or 23 in a further alteration of the excitation. Another excitation variant which is connected with slight restrictions (this time of the electrical properties of the antenna) provides the exclusive excitation of one of the fastening elements 22.1, 22.4, the particular other fastening element being electrically connected to the reflector 13 and/or 23. The deviation from the ideal symmetric directional characteristic connected therewith is permissible, particularly for use as an emitter element in a group antenna.

Depending on the activation, circular or elliptical polarizations, analogous to FIG. 2A or 2B, may also be achieved through phase-shifted excitation of the fastening element pairs 22.1, 22.3 and 22.2, 22.4, for example.

Figure 3A:
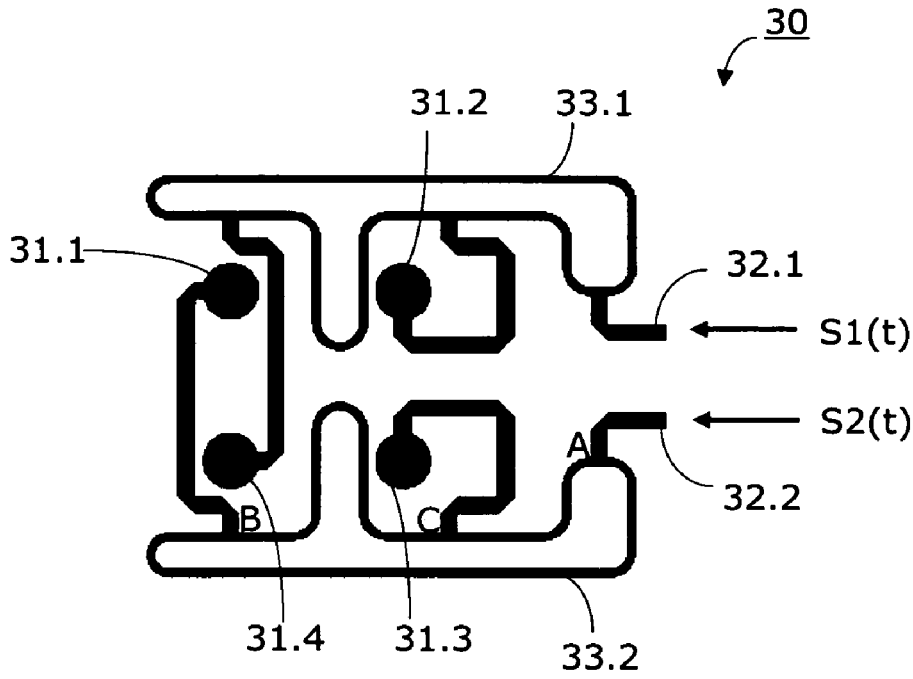
FIG. 3A shows a supply circuit according to the present invention which is located on the back of a reflector.

A network 30 according to the present invention is shown in FIG. 3A as an example. The network shown is located on the back of a reflector surface and has two supply inputs 32.1 and 32.2. Four gates 31.1 through 31.4 are provided, which are connected to the fastening elements (not shown in FIG. 3A) of the emitter element. A 180° hybrid 33.1 is positioned between the supply input 32.1 and the two ports 31.4 and 31.2. A further 180° hybrid 33.2 is positioned between the supply input 32.2 and the two ports 31.3 and 31.1. The 180° hybrid 33.2 includes a quarter-wave delay line between points A and C and a three-quarter-wave delay line between points A and B. In turn, the line between B and C represents a half-wave delay line. The delay lines are laid out on the basis of the average frequency of the feed signals. The ports 31.1 through 31.4 are connected via line parts to the two 180° hybrids 33.1 and 33.2, which each cause the same phase shift. The network 30 ensures that the respective diagonally opposite ports are activated phase-shifted by 180°, i.e., with opposite phases, through which the other two ports lie in a virtual short-circuit plane. The supply inputs 32.1 and 32.2 therefore have a high mutual decoupling. In this way, especially pure polarization of the emitted waves and/or a strongly suppressed cross-polarization component is obtained. Other embodiments of 180° power dividers for feeding the supply inputs 31.1 through 31.4 of FIG. 3A, which lie on the corners of a square, are possible, whose strip line layout may be performed according to the following generalized rule in order to achieve the greatest possible electrical symmetry: for example, one begins by fixing a contact point B on the straight lines given by supply inputs 31.1 and 31.4. While maintaining equal electrical line lengths between the supply input 31.1 and contact point B on one side and the feed point 31.3 and the contact point C on the other side, the position of the contact point C may be selected freely. The network input corresponding to the contact point A of the 180° hybrid in FIG. 3A may be positioned as desired. The strip line layout of the second 180° power divider is now obtained through two mirror images: in the first step, the layout of the first 180° power divider is reflected on the axis of symmetry, which transfers feed points 31.1 and 31.2 into feed points 31.4 and 31.3. In the second step, the layout of the connection line between the feed point 31.4 and contact point B of the second 180° power divider is merely reflected around the axis 31.1–31.4.

If the supply input 32.2 is now supplied with an HF signal S2(*t*), a signal with phase position 0° is applied to port 31.3 and a signal with phase position 180° is applied to port 31.1. Using the network 30 shown, a push-pull signal may therefore be generated from an HF signal S2(*t*). The emitter element builds up a +45° slant polarization with the feed shown. Alternatively, only supplying the supply input 32.1 generates a −45° slant polarization at the emitter element.

Now, for example, if the supply input 32.1 is supplied with an HF signal S1(*t*) and the supply input 32.2 is supplied with an HF signal S2(*t*), which are each in phase with one another, a signal with the phase position 0° is applied at gate 31.2, a signal with the phase position 0° is applied at the gate 31.3, a signal with the phase position 180° is applied at the gate 31.4, and a signal with the phase position 180° is applied at the gate 31.1. Using the network 30 shown, an excitation with opposite phases may be generated from each of two HF signals S1(*t*) and S2(*t*). The emitter element builds up a horizontal polarization with the feed shown.

If the supply inputs 32.1 and 32.2 are activated with opposite phases (i.e., S1(*t*) is phase shifted by 180° in relation to S2(*t*)), a vertical polarization is built up.

In order to achieve a circular polarization, the two supply inputs 32.1 and 32.2 are activated in such a way that S1(*t*) is phase shifted by +90° or −90° in relation to S2(*t*). In addition, elliptical polarizations may be generated if, at +90° or −90° phase shift, the amplitude of S1(*t*) differs from the amplitude of S2(*t*) and/or the phase shift deviates from 0°, +90°, −90°, and 180°.

It is an advantage of the exemplary network shown that the polarization properties of the antenna may be set without changing the emitter element, merely through suitable activation. Depending on the feed at the supply inputs, the polarization of the signals emitted from the emitter element may therefore be influenced.

The emitter element may also be activated through other supply circuits, for example, (combination) networks and delay lines. The supply circuit may be implemented in planar, coaxial, or waveguide line technology.

The supply circuit may be designed in such a way that it generates up to four different activation signals for activating the emitter element from one signal (e.g., S1(*t*)).

Figure 3B:
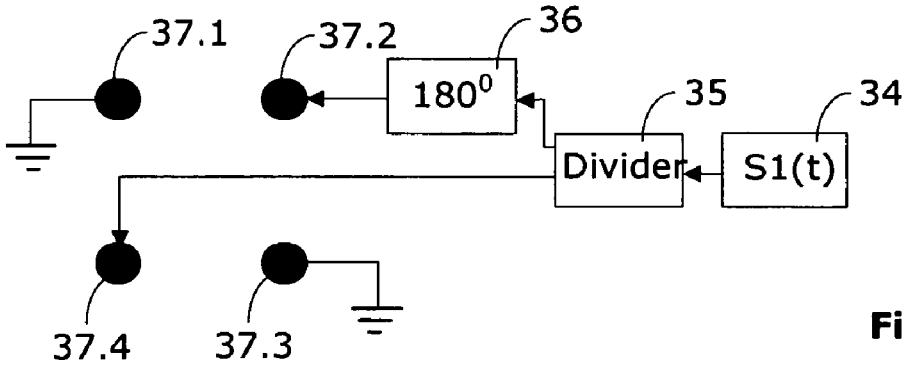
FIG. 3B shows a further supply circuit according to the present invention in a schematic block diagram.

Another example of a supply circuit is shown in FIG. 3B. The supply circuit has a supply input 34 to which a signal S1(*t*) is supplied. This is followed by a divider 35 whose first output signal is applied to a gate 37.4. The second output signal of the divider 35 is phase shifted via a 180° phase shifter 36 and then supplied to a gate 37.2. The two ports 37.1 and 37.3 are at ground. The supply circuit in FIG. 3B allows a single linear polarization.

Figure 3C:
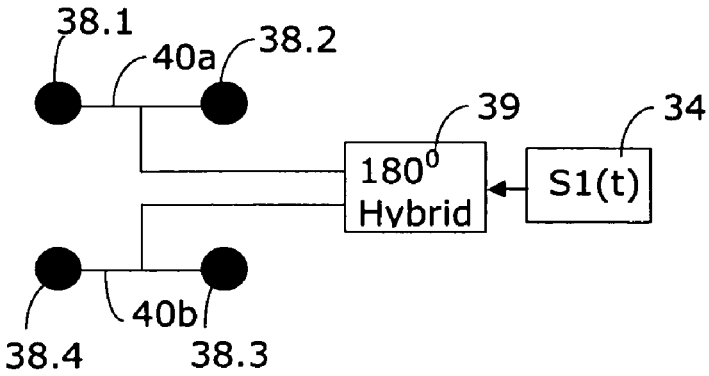
FIG. 3C shows a further supply circuit according to the present invention in a schematic block diagram.

A third example of a supply circuit is shown in FIG. 3C. The supply circuit has a supply input 34 to which a signal S1(*t*) is supplied. A 180° hybrid 39 feeds two connecting lines 40*a*, 40*b* in push-pull operation. Connecting line 40*a* connects the neighboring gates 38.1 and 38.2, connecting line 40*b* connects the neighboring gates 38.3 and 38.4. The connecting lines 40*a* and 40*b* preferably each include two identical arms positioned in mirror symmetry to the contact point of the 180° hybrid 39 and are identical.

According to the present invention, the peripheral structure may have any arbitrary shape which fulfills the following conditions:

- The peripheral structure is a closed peripheral structure having alternating constrictions and bulges.
- The peripheral structure spans an imaginary surface which is intersected by at least two planes of symmetry of the cast part.
- The planes of symmetry intersect in a joint intersection line which runs approximately perpendicular to the reflector.

In a preferred embodiment, the peripheral structure has four wing elements which are positioned symmetrically. If the points (bulges) of the peripheral structure which are furthest apart are approximately half a wavelength distant from one another, the peripheral structure acts like two crossed dipole elements. The two planes of symmetry of the cast part are preferably perpendicular to one another.

Each dipole element of the crossed dipole antenna is preferably supplied symmetrically.

Various regular peripheral structures are schematically indicated in FIGS. 4A through 4D, it being noted that there are numerous other shapes which are suitable as the peripheral structure. These regular peripheral structures have four planes of symmetry.

Figure 4A:
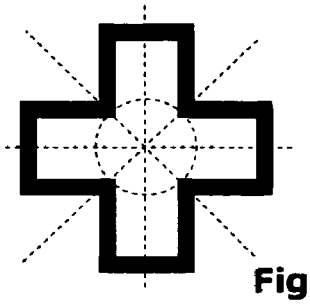
FIGS. 4A–4F show different regular peripheral structures according to the present invention.
Figure 4B:
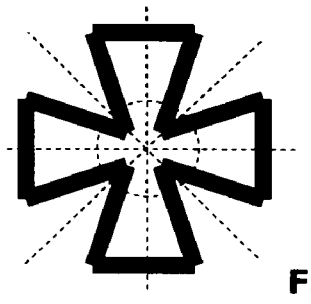
Figure 4C:
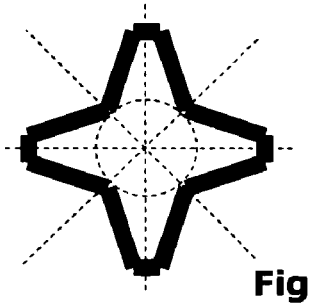
Figure 4D:
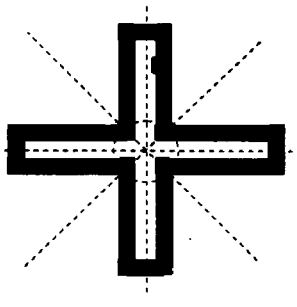
Figure 4E:
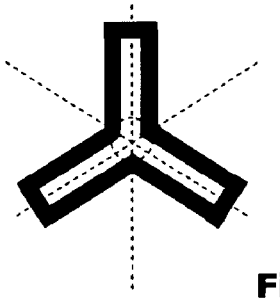
Figure 4F:
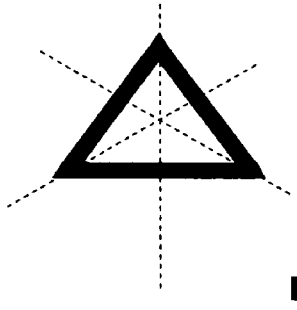

Further peripheral structures, now having three planes of symmetry, are shown in FIGS. 4E and 4F. The peripheral structure of FIG. 4E has three wing elements which are each positioned pivoted by 120° in relation to one another. If signals of identical amplitude and having 0°, 120°, and 240° phase shift are fed to the three constrictions, right or left circularly polarized emission is obtained. FIG. 4F shows a peripheral structure also capable of generating circularly polarized emission.

Figure 5A:
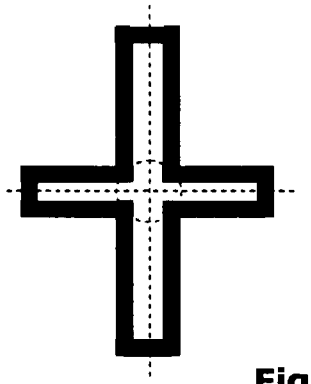
FIGS. 5A–5B show different irregular peripheral structures according to the present invention.
Figure 5B:
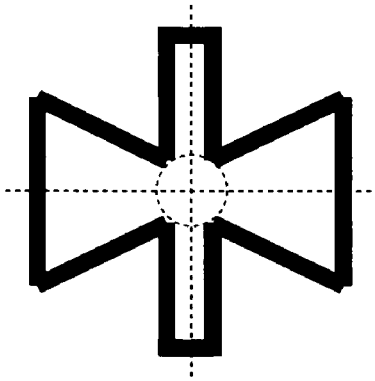

Different irregular peripheral structures are schematically indicated in FIGS. 5A and 5B. These irregular peripheral structures have at least two planes of symmetry and are preferably activated using a circuit corresponding to FIG. 3C. A further advantageous application of the peripheral structures in FIGS. 5A and 5B is the simplified generation of circular polarization by applying feed signals in phase opposition at two diametrically opposite constrictions.

The peripheral structure is preferably conceived in such a way that there are wing elements which result in at least one resonance circuit which is loaded by the emission.

The fastening elements are preferably implemented in such a way that transformers result from the excitation impedances on the resonator impedances.

Figure 6:
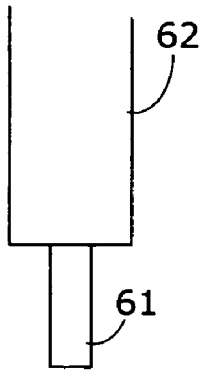
FIG. 6 shows a detail of a fastening element according to the present invention in a schematic side view.

In an advantageous design, the fastening elements implemented as the transformer have a diameter sufficiently large that they represent an interfering capacitive load against the conductive reflector surface. In order to reduce the capacitive load of the activation circuit, for example, fastening elements may be used which taper toward the reflector in such a way that an inductive input stage results. An example of such a fastening element is shown in FIG. 6 in a schematic side view. A fastening element is shown which has a first cylindrical region 62 having a first diameter. A second cylindrical region 61 is provided at the lower end of the first region 62, whose diameter is smaller than the diameter of the first region 62. The first region does not necessarily have to be positioned centrally on the second region. The fastening element shown is implemented in such a way that it may be removed from the mold easily after casting the molded part.

According to the present invention, the emission characteristic is essentially determined by the distance of the emitter element from the reflector. Preferably, between 1/10 and 1/3 of the emitted wavelength in air is selected as the distance of the emitter element from the reflector.

According to the present invention, a metallic shield arrangement may be provided which is connected completely, partially, or not at all to the conductive reflector surface. The shield arrangement preferably has the same planes of symmetry as the emitter element which it encloses. It may be constructed in one piece or from an appropriate number of individual elements, while observing the planes of symmetry. An especially advantageous arrangement includes a peripheral electrically conductive wall which, depending on the desired beam focusing, ends below or even above the point of the emitter element facing furthest away from the reflector surface 23. In addition, the shield arrangement may be used in order to reduce the mutual coupling between neighboring emitter elements in a group antenna.

Figure 7:
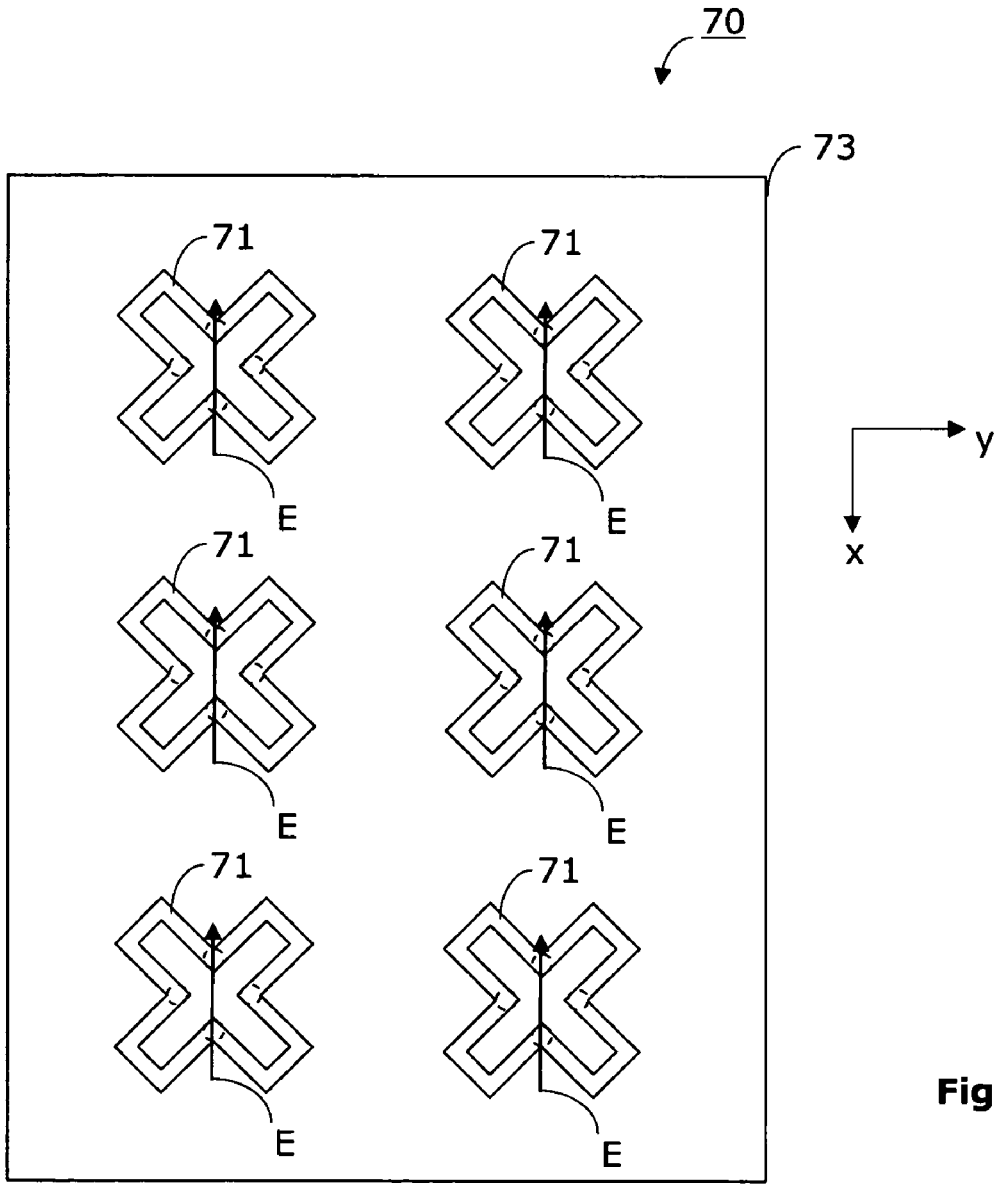
FIG. 7 shows a group antenna according to the present invention in a schematic top view.

A group antenna according to the present invention is distinguished in that multiple antennas are arranged in rows and columns. An exemplary group antenna 70 is shown in FIG. 7. The group antenna 70 includes two columns, each having three antennas 71. The emitter elements of the antennas 71 are positioned rotated by 45° in the example shown. However, the emitter elements may also assume any other orientation. In addition, it may be necessary or expedient to select the horizontal distance between the individual antennas differently than the vertical distance. A reflector surface 73 is positioned behind the emitter elements. There is a supply matrix (not visible in FIG. 7), which allows the antennas to be combined in rows and/or columns. Preferably, each antennas 71 includes an emitter element and an individual supply circuit. The supply matrix cited then produces the necessary connections between overall inputs of the group antenna and the supply inputs of the supply circuits. The supply matrix, the supply circuit, and the feed signal are laid out in the example shown in such a way that a linear polarization in the vertical direction results, as indicated by the electromagnetic fields.

The antennas described and shown are particularly suitable for operation in the gigahertz frequency range, the supply inputs having signals applied to them which have an average frequency greater than 1 GHz. The antennas are especially suitable for mobile wireless and other communication systems. The upper frequency limit may be approximately 25 GHz, where the diameter of the emitter elements according to the present invention is approximately 5 mm and the distance between the peripheral structure and the reflector plane may be less than 3 mm. In the range between approximately 10 GHz and 25 GHz, laying out the emitter elements as SMD (surface mounted devices) suggests itself, which are soldered directly onto a dielectric plate that carries the supply circuits, while avoiding vias. For this purpose, the lower ends 16 of the fastening elements 12.1 through 12.4 are preferably provided with a galvanic surface which may be wetted easily by the solder used, while in contrast the remaining three-dimensional structure of the emitter element is preferably covered by a coating which repels solder. This may be generated through dip lacquering, plasma coating with a dielectric coating, or selective deposition of a metal which may not be wetted by the solder used, for example. The reflector surface is preferably formed by a large-area conductive coating on the side of the dielectric plate facing away from the emitter element. An especially advantageous method for solder assembly is the use of solder balls of low mechanical tolerances, which cause reliable self-centering of the emitter element with proper dimensioning known from ball grid array (BGA) technology.

It is an advantage of the present invention that the emitter elements are producible in large piece counts, high molding accuracy being ensured. The term molding accuracy expresses the idea that a low-tolerance image of the tool cavity may be achieved by the molded part. The advantageous one-piece embodiment of the cast part forming the emitter element particularly guarantees the precise maintenance of the mirror symmetries necessary to achieve high cross-polarization decoupling. If the emitter element is composed of multiple (preferably identical) parts, this property is more difficult to achieve because of the assembly tolerances. The weight of an emitter element is typically very low. Depending on the material and frequency range, a weight may be achieved which is below 20 g for application at mobile wireless frequencies.

The individual and group antennas described are very compact. If the supply circuit is provided on the reflector, the wiring outlay is reduced significantly.

Multiple variations and modifications are possible in the embodiments of the invention described here. Although certain illustrative embodiments of the invention have been shown and described here, a wide range of modifications, changes, and substitutions is contemplated in the foregoing disclosure. In some instances, some features of the present invention may be employed without a corresponding use of the other features. Accordingly, it is appropriate that the foregoing description be construed broadly and understood as being given by way of illustration and example only, the spirit and scope of the invention being limited only by the appended claims.

What is claimed is:

1. An antenna having an emitter element which is positioned in front of a conductive reflector, characterized in that the emitter element includes a three-dimensional cast part, which has at least two planes of symmetry, which is conductive and has a closed peripheral structure having alternating constrictions and bulges, the peripheral structure spanning an imaginary surface which is intersected by at least two planes of symmetry, and which has at least two fastening elements, which extend essentially perpendicularly to the imaginary surface and support the peripheral structure at points which lie on at least one of the planes of symmetry and are connected to the reflector at their ends, at least one of the two fastening elements being used for electrical excitation of the emitter element; and whereby the peripheral structure and said fastening elements are cast as integral parts of the three-dimensional cast part.

2. The antenna according to claim 1, characterized in that the reflector has a flat surface which has a conductive side facing toward the cast part.

3. The antenna according to claim 2, characterized in that the imaginary surface spanned by the peripheral structure is flat or curved.

4. The antenna according to claim 2, characterized in that the cast part is a metal cast part.

5. The antenna according to claim 1, characterized in that the imaginary surface spanned by the peripheral structure extends essentially parallel to the reflector.

6. The antenna according to claim 5, characterized in that the cast part is a metal cast part.

7. The antenna according to claim 1, characterized in that the imaginary surface spanned by the peripheral structure is flat or curved.

8. The antenna according to claim 1, characterized in that the cast part is a plastic cast part which is partially or completely provided with a conductive coating, or the cast part is a metallized plastic injection molded part.

9. The antenna according to claim 1, characterized in that the cast part is a metal cast part.

10. The antenna according to claim 1, characterized in that the reflector has a supply circuit on the side facing away from the cast part.

11. The antenna according to claim 10, characterized in that the supply circuit includes a network in order to connect two supply inputs to the two fastening elements in such a way that they may be activated with opposite phases.

12. The antenna according to claim 11, characterized in that the supply circuit is designed in such a way that, depending on the feed at the supply inputs, the polarization of the signals emitted from the emitter element may be influenced.

13. The antenna according to claim 10, characterized in that the supply circuit includes two in-phase power dividers, each connecting neighboring fastening elements, which may in turn be activated with opposite phases by a balanced transformer.

14. The antenna according to claim 10, characterized in that the supply circuit on the side is implemented in planar, coaxial, or waveguide line technology.

15. The antenna according to claim 1, characterized in that the cast part is enclosed by a shield arrangement which is preferably metallized.

16. The antenna according to claim 1, characterized in that the at least two fastening elements lie in the cylinder surface of an imaginary cylinder whose longitudinal axis stands vertically on the conductive reflector.

17. A group antenna having multiple antennas according to claim 1, characterized in that the antennas are positioned in rows and columns and the group antenna comprises a supply matrix, through which the antennas are combined in rows and/or columns.

18. The group antenna according to claim 17, characterized in that each of the antennas has a supply circuit with supply inputs.

19. The group antenna according to claim 17, characterized in that connections between overall inputs of the group antenna and the supply inputs of the supply circuits may be produced by the supply matrix.

* * * * *